United States Patent [19]

Kutrieb

[11] 4,116,614

[45] Sep. 26, 1978

[54] OIL HEATER HAVING CONTROLLED OIL FLOW

[76] Inventor: Wolfgang A. Kutrieb, P.O. Box 1635, 1527 Beloit Ave., Janesville, Wis. 53545

[21] Appl. No.: 764,718

[22] Filed: Feb. 2, 1977

[51] Int. Cl.[2] ..... F23N 1/00

[52] U.S. Cl. ..... 431/89; 417/15; 417/315; 431/62; 431/207

[58] Field of Search ..... 431/331, 332, 333, 62, 431/12, 207, 222, 89; 417/15, 315; 123/139 AC

[56] References Cited

U.S. PATENT DOCUMENTS

| | | | |
|---|---|---|---|
| 1,849,162 | 3/1932 | Wilhjelm et al. | 431/12 |
| 1,886,430 | 11/1932 | Schofield | 431/12 |
| 2,000,580 | 5/1935 | Carruthers | 431/12 |
| 2,197,904 | 4/1940 | Terry | 431/12 |
| 2,334,679 | 11/1943 | Mason et al. | 431/12 |
| 2,693,849 | 11/1954 | Resek et al. | 431/333 |
| 3,236,449 | 2/1966 | Brunner | 431/12 |
| 4,036,195 | 7/1977 | Bailey | 123/39 AC |

*Primary Examiner*—Edward G. Favors
*Attorney, Agent, or Firm*—Harry C. Engstrom; Theodore J. Long; Nicholas J. Seay

[57] ABSTRACT

An oil heater particularly adapted to burning waste oil, having oil flow control apparatus providing substantially constant flow of oil to the vaporizer pan without regard to the viscosity of the oil being burned. The flow control apparatus utilizes a piston pump having relatively large input and output orifices, and is driven by a thermostatically controlled constant speed, reversible direction electric motor. Means are provided to transmit the power from the motor to the piston pump such that rotation of the motor in one direction provides a long pump stroke and high volume rate, whereas rotation of the motor in the opposite direction provides a short piston stroke and low volume rate of pumping to provide minimal oil flow to the vaporizer pan to allow combustion to be maintained in the heater.

9 Claims, 3 Drawing Figures

OIL HEATER HAVING CONTROLLED OIL FLOW

BACKGROUND OF THE INVENTION

1. Field of the Invention

This invention pertains generally to heaters utilizing oil as fuel, and more particularly to heaters adapted to the burning of oil of varying viscosities such as waste oil.

2. Description of the Prior Art

In order to provide combustion of the oil consumed by an oil heater, it is necessary to vaporize or atomize the oil to allow a proper oil-air mixture to be formed. Oil furnaces operating on standard grades of heating oil often utilize atomization of the oil, while smaller oil space heaters may provide the required combustible fuel-air mixture by vaporization of the oil by heating it to or near the boiling point of the oil. The oil vaporized by heating rises and draws air therewith to form the desired fuel-air mixture.

In oil space heaters in which the combustion mixture is formed by vaporization of the oil, the rate at which oil is supplied to the vaporization pan may be controlled manually or by thermostatically regulated valves such as a needle valve. Such oil heaters are not well adapted to on-off control of the oil being supplied to the vaporizing pan, since the pan must be maintained at a high enough temperature to vaporize the oil being supplied to it. Thus, if oil is shut off for a substantial period of time, combustion in the combustion chamber will cease and the vaporizing pan will cool down to the point that further vaporization of oil supplied thereto will not occur.

Supplying a controlled flow of oil to a vaporizing type oil heater becomes difficult where the oil heater is intended to operate on varying grades of fuel oil having varying viscosities, such as where the oil being burned is waste oil or discarded oil such as crankcase oil, hydraulic oil, various lubricating oils, and mixtures of various grades of oils. Because of the varying viscosities of such oil, common flow control techniques such as needle valves cannot be utilized to maintain a steady flow. Moreover, sediment and dirt particles are often countered in waste oil, and thus the oil line must contain no small orifices or other obstructions in the path of the oil flow if clogging of the oil line is to be avoided. It is nonetheless desired that the rate at which combustion occurs be controlled so that the oil heater may be turned up to a high temperature at a high constant oil flow rate where the ambient temperature surrounding the heater is below a selected temperature. It is also desired that the oil flow to the vaporizing pan be maintained at a selected very low rate to simply maintain vaporization and combustion within the heater when the temperature surrounding the heater is above a selected temperature. This is accomplished in some oil heater systems by the manual shifting of mechanical gears between the drive motor and the pump which pumps oil to the heater.

SUMMARY OF THE INVENTION

The oil burning heater of my invention utilizes a vaporizing type of heater unit wherein the waste oil is vaporized by the high temperatures at which a vaporizing pan is maintained. The heater is capable of burning fuels of widely varying viscosities, including waste oils which may have small particles of dirt and debris therein. The flow of oil to the pan is controlled at two flow rates, a first flow rate wherein the rate of oil supplied to the vaporizer pan is very low and is just sufficient to maintain combustion within the heater, and a second flow rate at which a much higher flow is provided to the vaporizer pan to provide the desired high level of heat from the heater. A heat sensitive thermostat automatically switches between the first and second flow rates to provide the high flow rate below a selected ambient temperature, and the low flow rate, just sufficient to maintain combustion at temperatures above the selected temperature. The rate of flow of oil to the vaporizer pan in either rates of flow is completely independent of the viscosity of the oil, and thus control of heating may be obtained without regard to the type of oil being burned.

The heater includes a heat radiating mantle, a burner pot supported within the mantle, and a vaporizer pan which rests within the burner pot. Hot vapors arising from the vaporizer pan draw in outside air and mix this air with the rising oil vapors to provide a combustible mixture. This mixture is burned above a diffuser ring in the burner pot and disperses heat to the mantle which distributes this heat into the room. Fumes are carried off through a flue opening at the top of the mantle.

The fuel supply to the vaporizer pan at either high or low flow rates is provided from a fuel tank to a piston type fuel pump in a flow control portion of the oil heater. The pump has a reciprocating piston therein which cooperates with a fuel inlet check valve and a fuel outlet check valve such that oil from the tank will be drawn into the pump cylinder on the upward or intake stroke of the piston, and will be forced out of the outlet by the downward or exhaust stroke of the piston. The pump is driven at a constant reciprocation rate but with a variation of the length of the stroke of the piston depending on whether high or low fuel flow is being provided. Power for driving the pump is provided preferably by a constant speed, reversible direction AC motor which is itself controlled by a thermostatic switch. The thermostatic switch reverses the direction of power supplied to the motor to thereby reverse the direction of the motor in response to variations of ambient temperature above and below a selected temperature. The electric motor preferably includes a gear train which reduces the speed of the motor at the output shaft thereof to a much lower constant speed, which may be conveniently selected to be within the range of approximately 20 to 120 revolutions per minute (rpm). The motor output shaft drives the pump through a cam system which converts the rotation of the output shaft of the motor to a long stroke of the piston when the motor is rotating in one direction and to a shorter piston stroke when the motor is rotating in the opposite direction. The short stroke of the piston is selected to provide sufficient oil only to maintain combustion within the heater, and to thereby maintain the vaporizing pan at a warm enough temperature to continue vaporization. The longer stroke of the piston corresponds to a much higher flow rate at which the heater is being utilized to positively heat up an area surrounding the heater to a temperature above ambient.

Because the piston pump does not utilize any narrow orifices or flow control valves, even dirty, relatively thick oil can be utilized and pumped therethrough. Moreover, the flow rate of oil into the vaporizing pan will be constant under any and all viscosities which will be normally encountered in the oil being burned.

Further objects, features, and advantages of my invention will be apparent from the following detailed description taken in conjunction with the accompanying drawings showing a preferred embodiment of an oil heater having controlled oil flow exemplifying the principles of my invention.

DESCRIPTION OF THE PREFERRED EMBODIMENT

Figure 1:
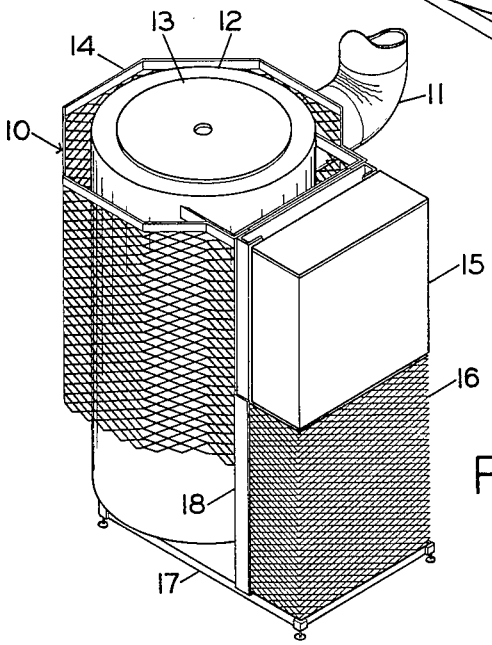
FIG. 1 is an overall exterior perspective view of an oil heater in accordance with my invention.

Referring now more particularly to the drawings, wherein like numerals refer to like parts throughout the several views, a preferred embodiment of my oil heater with controlled oil flow is shown generally at 10 in FIG. 1. The heater 10 is shown in a perspective exterior view in FIG. 1, positioned to be used as a space heater in a home or building, with the products of combustion being necessarily vented from the heater though a flue pipe 11. The heater 10 includes a generally cylindrical mantle 12 having a mantle lid 13 which may be removed to gain access to the interior of the mantle, a mantel guard 14 to prevent accidental contact with the hot mantle, an oil storage tank 15, a control unit guard 16, and a base plate 17 on which the foregoing components are mounted. A heat shield 18 protects the fuel tank 15 and the controls within the control unit guard 16 from the heat of the mantle.

Figure 2:
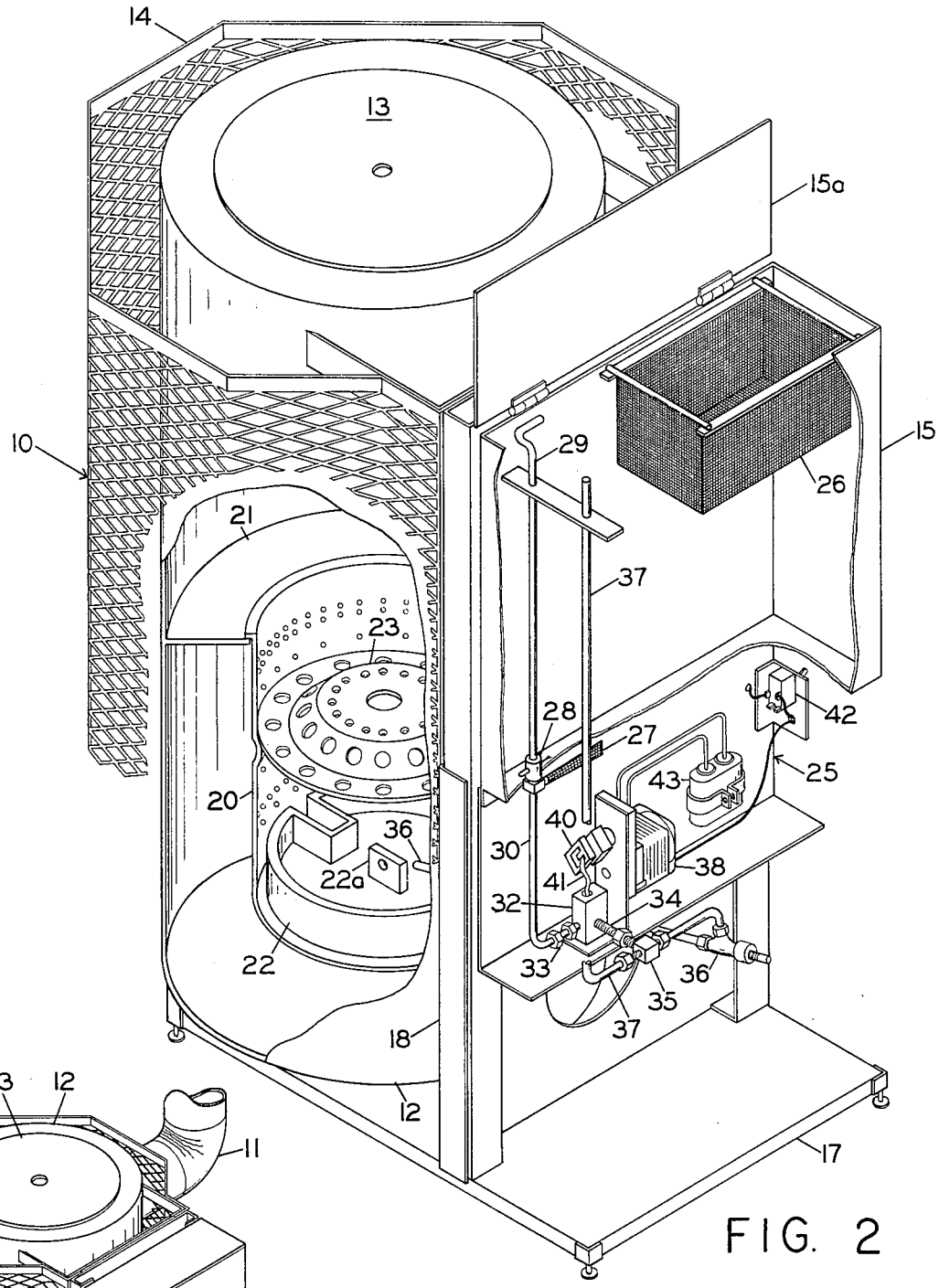
FIG. 2 is a perspective view of the heater of FIG. 1 with parts thereof broken away to show the internal construction thereof.

The details of construction of my heater apparatus are best shown with reference to the perspective view of FIG. 2, wherein various portions of the heating apparatus have been broken away to provide a view of the interior portions thereof. Within the cylindrical mantle 12, a removable burner pot 20 is mounted and supported above the bottom of the mantle 12 by a burner pot support plate 21. The burner pot support plate 21 extends circumferentially around the interior of the mantle 12 and is rigidly connected thereto, and has an opening wide enough to allow the pot 20 to fit down inside until a lip on the top of the burner pot engages with the shelf to provide support for the pot. The pot itself is cylindrically shaped as shown, and has a plurality of openings therein spaced around the circumference of the pot to allow air to be drawn into the pot to mix with hot rising oil vapors. A removable vaporizer pan 22 sits on the bottom of the pot 20 and collects the liquid fuel that is pumped therein. The pan 22 has a projection 22a with an opening therein which may be engaged by a poker or hook to allow the pan 22 to be removed and cleaned periodically. A removable diffuser ring 23 fits within the pot 22 and is supported in position by an indentation around the circumference of the pot. The diffuser ring 23 has a plurality of holes in its surface as shown, to force the rising mixture of oil vapors and air drawn up from the oil pan 22 to pass through the holes in directed streams. The upward rising vapors are ignited above the level of the diffuser ring 23, and combustion is maintained above the diffuser ring as long as vapors are rising through the openings of the ring. The air necessary to support combustion is drawn into the burner pot from the surrounding area within the mantle, and an opening (not shown) is provided in the wall of the mantle facing the heat shield assembly 18, to allow air to be drawn into the interior of the mantle.

Combustion is initiated in the oil heater by depositing a small amount of oil within the vaporizer pan 22, and heating this oil by burning paper or other easily combustible material within the pan to raise the temperature of the pan to the point where vaporization of the oil will occur. The diffuser ring 23 is then emplaced and the mantle 13 is closed, and combustion will continue within the oil heater as long as the supply of oil to the vaporizer pan continues. The rate of combustion will be generally proportional to the rate at which oil is supplied to the vaporizer pan and vaporized, until the pan becomes completely covered with oil such that more oil is present in the pan than can be immediately vaporized. It is apparent that the heat of combustion will be conducted back through the burner pot 20 to the vaporizer pan 22 to maintain the temperature thereof at a level which will allow vaporization to occur. It is also apparent that other means can be utilized to provide the initial temperature to warm the vaporizer pan 22, such as electrical heating elements embedded in the burner pot 20 or in the bottom of the mantle 12 in position to make contact with the bottom of the burner pot.

The heat shield wall 18 is mounted in a vertical position on the base 17, and separates the mantle 12 from the fuel tank 15 and the control portion of my heating apparatus. The wall 18 is preferably composed of a sheet of metal such as sheet steel, with a layer of insulating material such as fiberglass mounted thereover to minimize the transfer of heat from the mantle to the fuel tank and the controls. The fuel tank 15 and the oil flow control portion 25 of my heating apparatus are mounted on the heat shield 18. A flip-open lid **15*a* provides access to the fuel tank 15, and allows an operator to pour in waste oil through a coarse oil filter box 26 which filters out coarser sediment and particles within the waste oil. A filter sleeve 27 is fitted over the opening of the oil outlet port at the bottom of the tank 15 and provides another filter stage to prevent the entry therethrough of sediment and congealed oil which might clog the oil supply tubing. A shut-off valve 28 is provided at the outlet from the fuel tank 15 to cut off the flow of oil from the tank as desired. This valve is controlled by a shut-off rod 29 which extends upward from the valve 28 in a position where it can be operated by a user. It is apparent that additional oil from a larger storage tank could be pumped to the fuel tank 15** in the same manner that oil is supplied to standard oil burning furnaces.

Oil which is permitted to flow through the valve 28 flows through a fuel inlet pipe 30 into a fuel pump 32 within the flow control portion 25 of the heater. The pump 32 is a reciprocating piston pump and includes an inlet check valve 33 and a fuel outlet check valve 34. Oil that is drawn into and then forced out of the pump 32 passes through a two output orifice tee pipe 35 into a feed tube 36 which delivers the oil into the vaporizer pan 22. The other output orifice of the tee pipe 35 is connected to an overflow standpipe 37 which extends back upwardly into the tank 15 and has its opening near the top of the tank. If any overpressures are encountered because of clogging within the feed tube 36, the oil will be allowed to flow upwardly through the overflow pipe 37 and back into the tank. Because my system is operated at relatively low pressures, the head existing within the standpipe 37 is sufficient to preclude flow of oil therethrough as long as the feed tube 36 remains unblocked.

The pump 32 has a piston 32*a* therein which is driven in reciprocating motion by a constant speed electric motor 38 which preferably is geared down to reduce rotational speed at its output shaft 39. The output shaft 39 has a cam block portion 40 of a cam system mounted thereto which is connected to a piston rod 41 of the pump. As described below, the mounting of the piston rod 41 to the cam block 40 is accomplished such that the stroke of the piston pump 32 is shorter for rotation of the block 40 in one direction than it is for rotation of the block 40 in the opposite direction. The motor 38 is a reversible direction constant speed type AC motor which has a three wire connection thereto such that the polarity of the AC power supplied to the motor may be changed to change the direction of rotation of the motor. Power is supplied to the motor through a power switch 42 and a double pole single throw thermostatically controlled switch 43.

Figure 3:
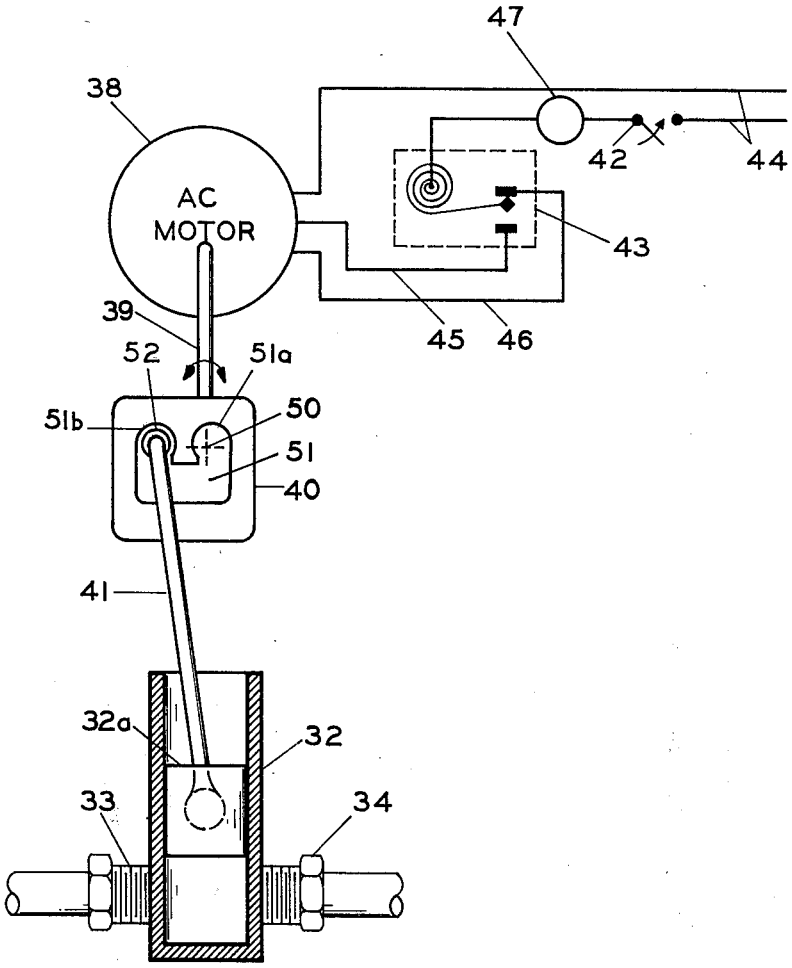
FIG. 3 is a schematic view of the oil flow control portion of my oil heater apparatus.

The operation of the flow control portion 25 of my heating apparatus is best shown with reference to the schematic view of FIG. 3. As shown in FIG. 3, the AC motor 38 preferably has three input terminals, one of which is directly connected to one line of a pair of standard 110 volt AC power lines 44. The motor 38 is constructed such that the direction which the motor will rotate will depend on which of the other two terminals of the rotor is paired with the first terminal to provide the motor with electrical power. As shown in FIG. 3, electrical conducting lines 45 and 46 are connected from the thermostat 43 to the outer two terminals of the motor such that either line may be paired with the conducting line 44 to effectively provide two pairs of input terminals to the motor. The thermostat 43 is connected such that it can be adjusted to switch power between the lines 45 and 46 at a selected temperature. As shown in FIG. 2, the thermostat 43 is mounted on the side of the heat shield 18 away from the mantle 12, so as to not be directly heated by the mantle, and will thus be exposed to the temperature generally surrounding the heater. Of course, heat will be conducted and radiated away from the immediate vicinity of the heater and will tend to warm up the room in which the heater is placed. As the room warms up, the rate of dispersal of heat from the heater slows, and the temperature of the thermostat 43 will rise high enough to cause switching of the thermostat to occur.

For safety, it is preferred that oil not be pumped into the vaporizer pan when the pan is not hot enough to cause vaporization. For this reason a safety cut-off thermostat switch 47 is connected in series in one of the power supply lines 44 to prevent power from flowing to the motor 38 when the mantle area is below a predetermined temperature. The cut-off thermostat 47 is preferably mounted on the wall of the mantle (not shown in the drawings) such that it can sense the mantle temperature near the burner pot 20.

As indicated above, the motor 38 is geared down through a series of reduction gears such that the rotational output at the output shaft 39 is at a relatively low rotational speed and a relatively high torque. For example, an output rotational speed of approximately 20 rpm to 120 rpm will provide a satisfactory rate of reciprocation for the piston pump 32. Such low reciprocation rates are desired since the fluids being pumped, such as waste oils, are relatively thick, viscous liquids which are more efficiently pumped at low flow velocities through relatively large and unobstructed piping. The rotational motion at the output shaft 39 of the motor 38 is converted to the reciprocating motion required for the pump 32 by the cam block 40 in cooperation with the piston rod 41. The cam block 40 is shown in detail in FIG. 3, although its mounting on the output shaft 39 of the motor is shown schematically. The cam block 40 is preferably formed of a solid thick plate of metal with the output shaft 39 being mounted to the block at an off center position shown illustratively by the intersection of the dashed lines labelled 50 in FIG. 3. The face of the block has a generally U-shaped channel 51 formed therein of two spaced legs 51*a* and 51*b* connected at one of their ends, with one of the legs of the "U" of the channel formed closer to the center of rotation 50 than the other leg of the channel. The channel 51 is preferably formed with rounded corners and with somewhat semi-circular end walls on the legs of the channel. A cam wheel 52 rides within the channel 51, and is rotatably mounted to the end of the connecting rod 41. It is seen that this eccentric mounting of the block 40 to the output shaft of the motor 38 will result in a larger or smaller arc of rotation of the cam wheel and a longer or shorter stroke of the connecting rod 41 and piston 32*a*, depending on whether the cam wheel 52 is located in the leg 51*a* of the channel 51 which is closest to the center of rotation, or in the leg 51*b* of the channel which is furthest away from the center of rotation. It is also seen that when the direction of rotation of the motor 38 is reversed by switching of the thermostat 43, the cam wheel 52 will move downwardly in the channel 51 and will migrate toward the other leg until it comes in contact with the end wall of the other leg, at which point it will be carried along by the end wall in rotation with the rotating block 40. The rate of flow of oil to the vaporizer pan 22 will, of course, be determined by the length of the stroke of the piston 32*a* within the pump 32, since the rate of rotation of the motor is the same in either direction of rotation.

The rate of flow when the cam wheel is being rotated within the leg 51*a* of the channel is preferably set such that only enough oil is supplied to the vaporizing pan to maintain combustion within the heater. The flow rate where the cam wheel is rotated by the leg 51*b* of the channel is at a much higher rate and is sufficient to provide the desired high heating temperature within the mantle of the heater. It is apparent that the rate of flow at both the low flow rate and at the high flow rate may be changed by changing the cam block 40 such that the legs of the channel 51 are spaced either closer to or further away from the center of rotation of the block, or by making one of the legs of the channel longer than the other leg. The flow rate may also be made adjustable by providing a movable end wall within one or both of the legs of the channel such that the distance of the cam wheel from the center of rotation may be adjusted.

As described above, the rate of flow of oil through the pump 32 into the vaporizer pan is closely controlled by the control of the reciprocation rate of the pump. The piping and supply tubes in the oil lines are selected to be large enough to provide flow of the oil therein without substantial frictional opposition to flow, and the check valves 33 and 34 are large enough so as to provide free flow therethrough in the forward direction. Thus, the flow of oil to the pan will be almost precisely equal to the volumetric displacement of the piston within the pump 32 as it proceeds through a full stroke cycle.

It is understood that my invention is not confined to the particular construction and arrangement of parts herein illustrated and described, but embraces all such modified forms thereof as come within the scope of the following claims.

I claim:

1. An improved oil burning heater of the type having a vaporizer pan for vaporizing by action of heat the oil that is supplied thereto, a feed tube for supplying oil to the vaporizer pan, and a fuel tank for holding oil, wherein the improvement comprises:

(a) a reciprocating piston pump having an inlet for receiving oil from the fuel tank on an intake stroke of the piston of said pump and an outlet for exhausting oil therefrom to the feed tube on an exhaust stroke of the piston;

(b) drive means for driving the piston of said pump at a constant reciprocation rate and at a selected one of a long reciprocating piston stroke and a shorter reciprocating piston stroke; and (c) means responsive to temperature for controlling said drive means to drive said pump at said long stroke below a selected temperature and at said short stroke above the selected temperature.

2. The improved heater of claim 1 wherein said drive means includes a reversible direction electric motor having an output shaft, said motor being adapted to provide a constant speed output in each direction of rotation, and wherein said drive means also includes cam means, mounted to the output shaft of said motor and connected to the piston of said piston pump, for converting the rotation of the output shaft of said motor to a long reciprocating stroke of the piston of said pump when said motor is rotating in one direction and to a shorter reciprocating stroke of the piston of said pump when said motor is rotating in the opposite direction.

3. The improved heater of claim 2 wherein said cam means includes a cam block mounted for rotation on the output shaft of said motor, said block including walls defining a channel formed therein having two spaced legs connected at one of their ends such that said channel is substantially U-shaped, said channel having a first leg which is closer to the center of rotation of said block than the second leg of said channel, and including a cam wheel movable in said U-shaped channel between the end wall of said first leg and the end wall of said second leg, said cam wheel being rotatably mounted to a piston rod connected to the piston of said piston pump, whereby rotation of said cam block in one direction will cause said cam wheel to be carried by the end of the first of said legs of said channel around an arc of rotation to provide said short reciprocating stroke of the piston of said piston pump, and whereby rotation of said block by said motor in the opposite direction will carry the cam wheel by the end of the second of said legs of said channel in a larger arc of rotation to drive the piston of said piston pump in said long reciprocating stroke.

4. The improved heater of claim 2 wherein said electric motor is adapted to receive power at either of two pairs of input terminals thereof such that said motor rotates in a direction to drive said pump at said short reciprocating stroke when power is supplied to a first pair of said input terminals and rotates in the opposite direction when power is supplied to a second pair of said input terminals, and wherein said means responsive to temperature includes a thermostatically controlled electrical switch adapted to be connected to a source of input power and being connected to said two pairs of input terminals of said electric motor, and wherein said thermostatic switch is switched to provide power to said first pair of said input terminals above a selected temperature and switches to provide power to said second pair of input terminals below the selected temperature.

5. The improved heater of claim 1 including pressure relief means connected to the output of said pump, said pressure relief means including a two output orifice tee pipe having an input connected to receive oil from said pump and which is connected at one of its outputs to the oil feed tube leading to the vaporizer pan, and including a vertically extending overflow pipe connected at one end to the other output orifice of said tee pipe and having the other end thereof extending upwardly into the heater fuel tank.

6. Oil flow control apparatus for a vaporizer type oil heater, comprising:

(a) a reciprocating piston pump having an inlet for receiving oil therein on an intake stroke of the piston of said pump and an outlet for exhausting oil therefrom on an exhaust stroke of the piston;

(b) a reversible direction electric motor having an output shaft, said motor being adapted to provide a constant speed output in each direction of rotation;

(c) cam means, mounted to the output shaft of said motor and connected to the piston of said piston pump, for converting the rotation of the output shaft of said motor to a long reciprocating stroke of the piston of said pump when said motor is rotating in one direction and to a shorter reciprocating stroke of the piston of said pump when said motor is rotating in the opposite direction; and (d) means responsive to temperature for supplying electricity to said motor to cause said motor to rotate in the direction to drive said pump at said long reciprocating stroke below a selected temperature and to rotate said motor in the opposite direction to drive said pump at said shorter reciprocating stroke above the selected temperature.

7. The flow control apparatus of claim 6 wherein said cam means includes a cam block mounted for rotation on the output shaft of said motor, said block including walls defining a channel formed therein having two spaced legs connected at one of their ends such that said channel is substantially U-shaped, said channel having a first leg which is closer to the center of rotation of said block than the second leg of said channel, and including a cam wheel movable in said U-shaped channel between the end wall of said first leg and the end wall of said second leg, said cam wheel being rotatably mounted to a piston rod connected to the piston of said piston pump, whereby rotation of said cam block in one direction will cause said cam wheel to be carried by the end of the first of said legs of said channel around an arc of rotation to provide said shorter reciprocating stroke of the piston of said piston pump, and whereby rotation of said block by said motor in the opposite direction will carry said cam wheel by the end of the second of said legs of said channel in a larger arc of rotation to drive the piston of said piston pump in said long reciprocating stroke.

8. The flow control apparatus of claim 6 wherein said electric motor is adapted to receive power at either of two pairs of input terminals thereof such that said motor rotates in a direction to drive said pump at said short reciprocating stroke when power is supplied to a first pair of said input terminals and rotates in the opposite direction when power is supplied to a second pair of said input terminals, and wherein said means responsive to temperature includes a thermostatically controlled electrical switch adapted to be connected to a source of input power and being connected to said two pairs of input terminals of said electric motor, and wherein said thermostatic switch is switched to provide power to said first pair of said input terminals above a selected temperature and switches to provide power to said second pair of input terminals below the selected temperature.

9. The flow control apparatus of claim 6 including pressure relief means connected to the output of said pump, said pressure relief means including a two output orifice tee pipe having an input connected to receive oil from said pump and which is adapted to be connected at one of its outputs to an oil feed tube supplying a vaporizer pan of an oil heater, and including a vertically extending overflow pipe connected to the other output orifice of said tee pipe.

* * * * *